United States Patent [19]

Blitshteyn

[11] Patent Number: 4,872,083

[45] Date of Patent: Oct. 3, 1989

[54] METHOD AND CIRCUIT FOR BALANCE CONTROL OF POSITIVE AND NEGATIVE IONS FROM ELECTRICAL A.C. AIR IONIZERS

[75] Inventor: Mark Blitshteyn, Lansdale, Pa.

[73] Assignee: The Simco Company, Inc., Hatfield, Pa.

[21] Appl. No.: 221,636

[22] Filed: Jul. 20, 1988

[51] Int. Cl.[4] ..... H01T 23/00; H05F 3/04

[52] U.S. Cl. ..... 361/213; 361/229; 361/230; 250/324; 55/139; 323/903

[58] Field of Search ..... 361/212, 213, 229, 230, 361/231, 233–235; 250/324–326, 423 F; 55/105, 139; 323/903

[56] References Cited

U.S. PATENT DOCUMENTS

| | | | |
|---|---|---|---|
| 4,618,249 | 10/1986 | Minor | 355/14 CH |
| 4,638,397 | 1/1987 | Foley | 361/212 |
| 4,808,200 | 2/1989 | Dallhammer et al. | 55/105 |

*Primary Examiner*—A. D. Pellinen
*Assistant Examiner*—David Osborn
*Attorney, Agent, or Firm*—Stanley Bilker

[57] ABSTRACT

A balancing system for electrical A.C. air ionizers having at least one discharge electrode adjacently spaced from a proximity ground and connected to the high side of an A.C. high voltage power source includes (a) a capacitor interposed between each electrode and the high voltage source to maintain a bias on each of the electrodes by blocking the D.C. current component across the circuit capacitance between the discharge electrodes and ground, and (b) a by-pass resistor across the circuit capacitance for providing a path to ground to bleed off excess bias so that equal positive and negative ion densities are generated during corona flow, the by-pass resistor having a resistance value which is determined by the parameters of the system's corona characterisitics (including corona onset voltage and average current flow) that will provide a required equilibrium bias for producing the correct ratios of positive and negative ion currents as will balance the ion densities. Adjustable means are also provided for varying the by-pass resistance to compensate for changes in positive and negative ion flow that are caused by environmental factors and contamination.

7 Claims, 3 Drawing Sheets

METHOD AND CIRCUIT FOR BALANCE CONTROL OF POSITIVE AND NEGATIVE IONS FROM ELECTRICAL A.C. AIR IONIZERS

BACKGROUND OF THE INVENTION

1. Field of the Invention

This invention relates to A.C. ionizers and more particularly relates to a method and control for balancing the positive and negative ion output of such air ionizers whereby efficient static neutralization of the article surface or zone at which the ionization is directed may be provided.

2. Prior Art

As is well known, static eliminators are devices for producing both positive and negative ions in order to neutralize articles or surfaces which have been charged to a particular polarity. A typical electrical air ionizer operating on alternating electrical current comprises a high voltage transformer whose output is connected to one or more sharp electrodes located in the proximity of electrical ground. A.C. current is used because of the desire to produce both positive and negative ions essentially simultaneously. While both positive and negative ion production could be exactly equal under certain circumstances, in most instances, ions of a particular polarity will predominate depending upon the geometry of the A.C. air ionizer and whether the ionizing points are directly or capacitively coupled to the A.C. high voltage.

The ions of either polarity are only created or generated when the voltage on the discharge electrodes exceeds the corona onset threshold or level. That is, there is no ion generation when the voltage on the points is below the corona threshold. This corona onset level is a function of the sharpness of the discharge electrodes, its distance from a proximity ground and certain other variables, for example, atmosphere of operation and electrode contamination.

A schematic representation of a direct coupled air ionizer is shown in FIG. 1 wherein the high side of a transformer T is connected directly to points P which are adjacently spaced from a proximity ground, usually in the form of a conductive casing A. However, the corona electrode P to which an A.C. high voltage is applied can be shown as having an equivalent circuit, as set forth in FIG. 2 wherein:

Capacitance C2 is the total capacitance of the corona electrode to ground;

Variable resistance R1 is the electrical resistance of the air between the ionizing electrode P and ground when ions are being generated (i.e. electrode voltage above corona onset); and Switch SW represents the intermittent nature of the ion flow - the switch being open when the point voltage is below corona onset (no ions being generated in the air gap) and closed when the point voltage exceeds the corona onset (ions flowing from point P through the air gap to ground).

In the direct coupled A.C. air ionizer, such as shown in U.S. Pat. No. 3,137,806 or U.S. Pat. No. 3,156,847 (air gun), there is usually a predominance of negative ions emitted even though the discharge points are connected to an A.C. high voltage source having equal positive and negative high voltage amplitudes. This excessive negative ion production is the result of the inherent differences in positive and negative corona characteristics, firstly because the threshold voltage for corona onset in the case of negative corona is lower than for positive thereby causing a longer period during which the negative ions are created, and secondly because the current versus voltage curve (I-V) is much steeper in the case of negative than with the positive.

This may be readily seen from the curves of FIG. 3 wherein as a result the negative corona is present for a longer period of time than positive corona. Furthermore, the resistance of air between the corona electrode and ground is lower for the negative corona in part because of the greater mobility of negative ions. To reflect these differences, the equivalent circuit in FIG. 4 has been modified, wherein:

R1(−) represents the resistance of air during a negative half-cycle of operating voltage, and R1(+) represents the resistance during a positive halfcycle of operating voltage.

While the switching action of switch SW should produce a D.C. bias voltage on the point-to-ground capacitance C2 because of the difference in the positive and negative corona onset and corona current, this bias cannot sustained because instantaneous bleed-off to ground occurs through the low impedance of the transformer secondary.

In prior U.S. Pat. to Walkup, No. 2,879,395, a small D.C. power supply was incorporated between the proximity ground casing and the A.C. generator. It functioned by placing a D.C. bias of the proper polarity on the casing or on the discharge points and was connected in such a way as to retard the output of ions of the usually predominant polarity and/or enhance the output of ions of the opposite polarity. However, the additional power supply even though small made this system bulky and expensive.

Another but less expensive system of balancing the production of positive and negative ions is shown in the Takahashi Patent No. 3,714,531 wherein a diode-resistor parallel circuit replaced the small D.C. generator of Walkup. However, this system does not provide balanced ionization under changing voltage or varying environmental conditions, and the resistor has to be readjusted with every change in applied voltage.

In Antonevitch Patent No. 4,423,462, the biasing circuit for balancing was connected to the primary of a transformer and included a series-connected diode and variable resistor in one leg of a parallel circuit and a capacitor in the other. By selecting appropriate time constants for the resistance and capacitance, one could narrow the first half of the sine wave and broaden the second half to produce a desired number of positive or negative ions as desired depending upon the direction of the diode. The emission could be controlled to yield an equal number of ions of each polarity or a predominance of one polarity regardless of whether the A.C. high voltage was directly connected or capacitively coupled to the points. The problem with this design, as with the one before, is that constant readjustment is required as conditions change.

In Levy Patent No. 4,092,543, additional pointed needles were adjustably positioned in adjacently spaced from and interacting disposition with at least some of the discharging electrodes and means constituting a conductive path to the other side of the A.C. supply were provided to draw off a portion of the negative ion emission so as to enable emission of an equal number of ions of each polarity.

In the case of capacitively coupled air ionizers there is usually a predominance of positive ions emitted, the greater positive ion production resulting from the fact that a D.C. voltage is developed across the coupling capacitance in the direction which biases the points slightly in a positive direction. That is, in a capacitively coupled system, such as shown in Schweriner Patent No. 3,120,626 or No. 3,179,849 (air gun), a capacitance was included between the discharge points and the power supply in order to limit the short circuit current that can be drawn from a point.

In U.S. Pat. No. 4,188,530, an air stream was blown across the capacitively coupled points in order to extend the range of ionization. However, while it has been common to utilize capacitive coupling between the high voltage transformer and the ionizing electrodes, as shown in the schematic circuit of FIG. 5, in order to limit current for safety purposes, it has not been understood until now how the capacitive coupling may serve as an automatic compensator for the difference in the positive and negative corona characteristics.

SUMMARY OF THE INVENTION

It is therefore an object of this invention to provide a method and circuit for controlling and balancing the positive and negative ion emission from A.C. air ionizers.

Another object of this invention is to provide A.C. air ionizer circuitry and method therefor in which balance of ion emission can be controlled by incorporating a capacitive coupling between the discharge points and the high voltage power supply.

Still another object of this invention is to provide a method for controlling the balancing of an A.C. air ionizer by incorporating a capacitor between the discharge electrodes and the high voltage power supply and a by-pass resistor between the electrode points and ground in order to bleed off bias at a controlled rate across the circuit capacitance between the points and ground.

Another object of this invention is to provide an improved device and method of the character described that is easily and economically produced, sturdy in construction, and highly efficient and effective in operation.

According to this invention, there is provided a circuit and method for balancing the emission of positive and negative ions from A.C. air ionizers having at least one discharge electrode connected to the high side of an A.C. power source and adjacently spaced from a proximity ground or conductive casing by the interposition of a capacitor between each discharge electrode and the high voltage source to maintain the bias on each of the electrodes. The capacitor blocks the D.C. current component across the circuit capacitance between the discharge electrodes and ground. Also provided is a resistor for lowering the positive bias voltage to compensate for greater mobility of negative ions, the latter tending to recombine with ground at a higher rate. Lower positive bias increases the negative and decreases the positive ion current flow when above the corona threshold. Means can also be included to adjust the by-pass resistance to compensate for contamination of the electrodes or environmental changes, such adjusting means contemplating sensors for monitoring changes in corona discharge conditions and feeding back a signal proportional to the changes so as that the resistance may be automatically and selectively modified.

BRIEF DESCRIPTION OF THE FIGURES

With the above and related objects in view, this invention consists of the details of construction and combination of parts as will be more fully understood from the following detailed description when read in conjunction with the accompanying drawings, in which:

FIGS. 1 to 5 constitute representations of the prior art.

DETAILED DESCRIPTION

Figure 1:
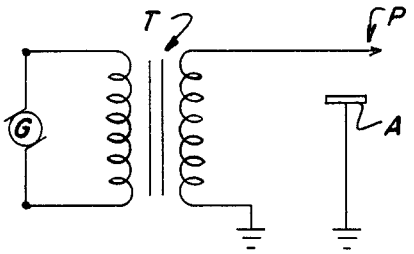
FIG. 1 PRIOR ART
FIG. 1 is a schematic diagram of the circuit for a conventional direct coupled A.C. air ionizer.
Figure 2:
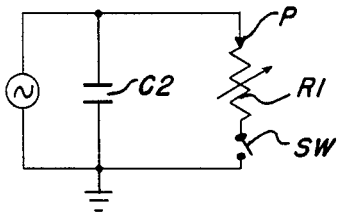
FIG. 2 PRIOR ART
FIG. 2 is a diagrammatic representation of the equivalent circuit for a corona electrode directly coupled to an A.C. high voltage power supply.
Figure 4:
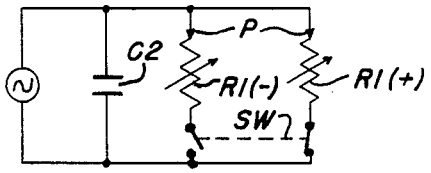
FIG. 4 PRIOR ART
FIG. 4 is a diagrammatic representation of the equivalent circuit for an A.C. direct connected air ionizer showing the switching effect from positive and negative current flow in the air gap between the electrodes and the proximity ground.
Figure 5:
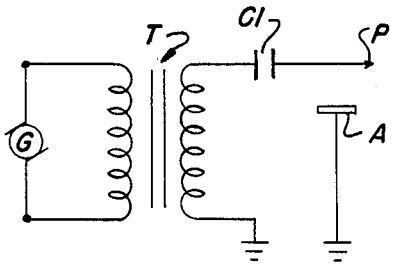
FIG. 5 PRIOR ART
FIG. 5 is a schematic diagram of the circuit for a capacitively coupled air ionizer.
Figure 6:
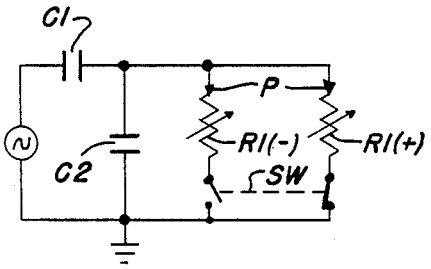
FIG. 6 is diagrammatic representation of the equivalent circuit for a corona electrode capacitively coupled to an A.C. high voltage power supply showing corona flow switching effects.

Referring now in greater detail to the drawings in which similar reference characters refer to similar parts, I show a balancing method and apparatus for controlling the positive and negative ion emission from an A.C. electrical air ionizer wherein, as shown in FIG. 6, a capacitive coupling C1 is first included between the high side of the high voltage power supply G and the ionizer's corona discharge electrode or points P in order to automatically compensate for the difference in positive and negative corona characteristics.

Figure 7:
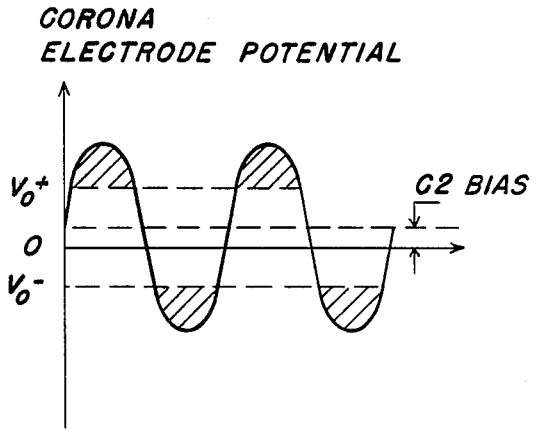
FIG. 7 is a graphic representation of corona electrode voltage waveforms with typical positive and negative corona onset voltage levels in a capacitively coupled A.C. air ionizer having a bias voltage.

As is shown in FIG. 7, the effect of the switching action of "equivalent" switch SW caused by current flow in the air gap produces a bias voltage on capacitance C2. Now the capacitive coupling C1 blocks the D.C. component of current, (that which had previously leaked off in the direction coupled air ionizer), thereby enabling the bias to be maintained. That is, the coupling capacitor C1 has now prevented the bias voltage from bleeding off to ground through the low impedance of the secondary winding of transformer T. This positive C2 bias, in effect, compensates for the difference between the two coronas whereby equal positive and negative ion currents are generated.

While this bias level depends on the differences between the positive and negative corona onset voltages and the form of the I-V curves for the two coronas, it should be noted that these corona currents and corona onset levels vary continuously with minute changes in operating voltage, environmental conditions, point contamination and the like. The value amount of this bias on the point-to-ground capacitance C2 follows these changes and helps to maintain a stable ratio of positive and negative ions. Furthermore, even with equal positive and negative ion currents being generated, there will not be a balance of positive and negative ion densities in the air gap. There will be more positive than negative ions in the gap because the negative ions cross the gap more rapidly as a result of their greater natural mobility.

If there are unequal positive and negative ion densities in a given volume, insulators or isolated conductive objects placed in the vicinity will accept and develop a net charge, and their electric potentials will necessarily increase. This potential of an isolated object produced by and due to an ionizer is defined as a potential of imbalance, which is actually a measure of ion flow imbalance. Ion flow imbalance is primarily characteristic for ionized air blowers which direct a stream of air with the ions contained over an extended range toward the target object.

Figure 8:
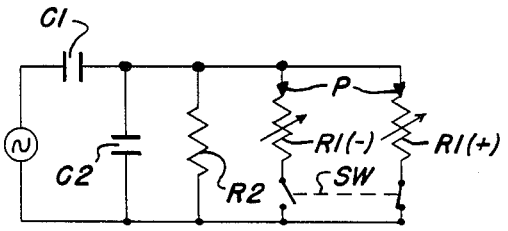
FIG. 8 is a diagrammatic representation of the equivalent circuit for an A.C. capacitively coupled air ionizer including a resistance element embodied by the instant invention incorporated across the electrode-to-ground capacitance.
Figure 3:
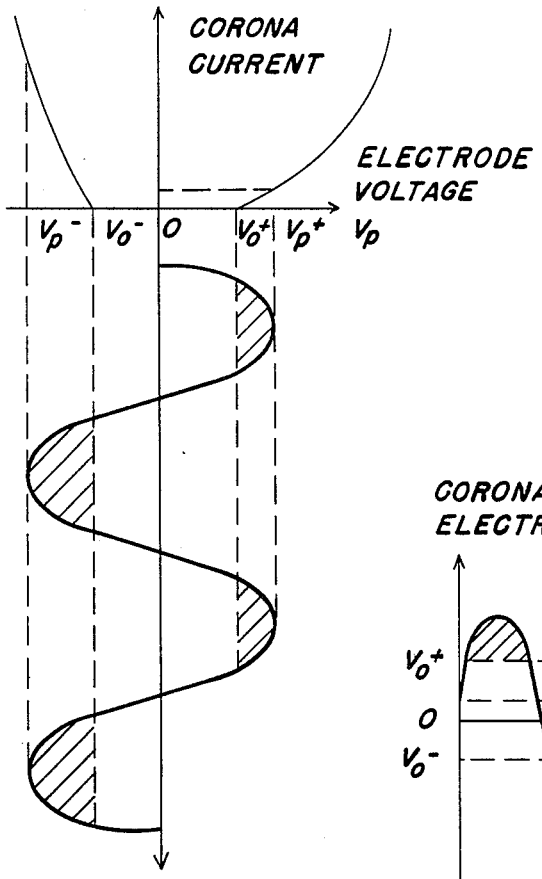
FIG. 3 PRIOR ART
FIG. 3 is a graphic representation of typical current-voltage curves for positive and negative D.C. coronas, and their effect on direct coupled A.C. corona generation.

Beacuse ions are delivered to the surface by a forced air stream, an excess of ions of one polarity or the other results in charging of an isolated target surface. Depending upon the design and purpose of the ionizer, different biases may be required to balance the ion flow. Therefore, an additional adjustment of the ion current balance is required and must be made. That is, the positive bias voltage should be lowered in order to increase the negative and decrease the positive ion current. The rate of positive and negative ion generation can be adjusted by controlling the value of the bias on capacitance C2. This can be accomplished by adding a control resistance R2 across the capacitance C2, as is shown in FIG. 8, in order to provide a path to bleed off the extra bias and change the balance of ions.

For any given value of capacitance C2 and electrode geometry, other things being constant, an equilibrium bias can be established that provides the correct ratio of positive and negative ion currents, and a value of resistance R2 can be determined to balance ion densities.

The value of resistor R2 can be determined from the following formula:

$$R2 = \frac{4V_s(C1 + C2)}{V_s(G_-K_-^2 - G_+K_+^2)C1}$$

where

C1 is the capacitance of the coupling capacitor;

C2 is the total point-to-ground system capacitance;

$V_s$ is the bias voltage established on capacitor C2 and adjusted by the resistor R2 to compensate for the difference in mobilities of positive and negative ions;

$V_s$ is the power supply voltage amplitude;

$G_+$ and $G_-$ are average slopes of the current voltage curves for positive and negative corona respectively;

$$K_+ = 1 - \left(\frac{C1 + C2}{C1}\right)\left(\frac{V_o^+}{V_s}\right) \text{and}$$

$$K_- = 1 + \left(\frac{C1 + C2}{C1}\right)\left(\frac{V_o^-}{V_s}\right)$$

where $V_o^+$ and $V_o^-$ are corona onset voltages for positive and negative corona respectively.

Even though the above formula allows relatively accurate estimate of R2 value, it is not practical to use such a formula because of the difficulty in calculating and determining most of its terms.

The alternative way of calculating R2 is to determine the R2 value experimentally by incorporating various resistances R2 across the point-to-ground capacitance C2 of the particular air ionizing device and measuring the potential imbalance at the isolated metal plate until the ion density balance is achieved.

Figure 9:
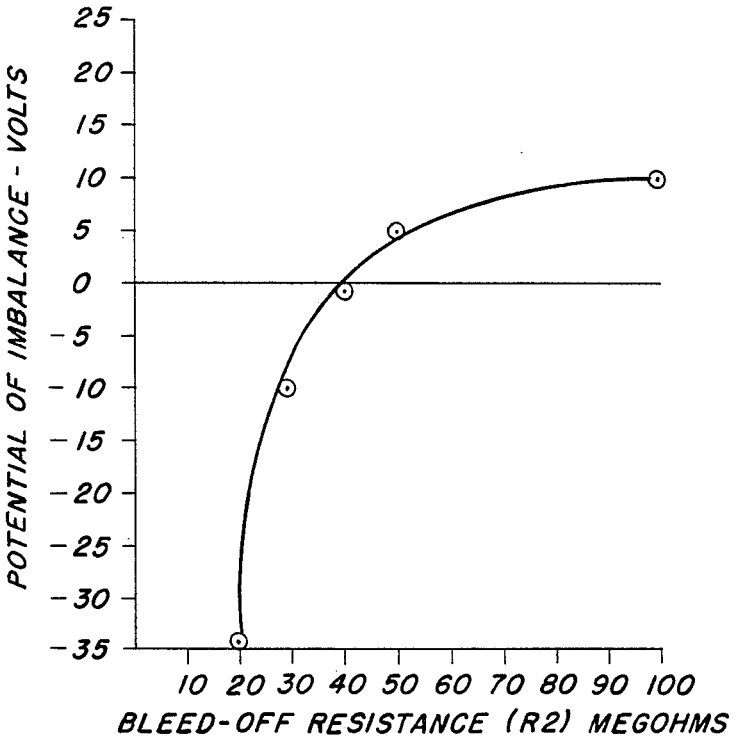
FIG. 9 is typical curve for an A.C. multi-point air ionizer plotting the effect of bleed-off resistance versus the potential of imbalance of an isolated plate.

Referring to FIG. 9, there is shown a typical curve showing the relationship between a resistance R2 and the potential of imbalance developed on an isolated metal plate as a result of ion flow from an A.C. air operated ionized air blower. The ion source in this instance used twenty-two electrodes positioned 3/8 inch from a grounded perforated metal plate. Total capacitance C2 was 15 picofarads, and coupling capacitor C1 was 100 picofarads.

Figure 10:
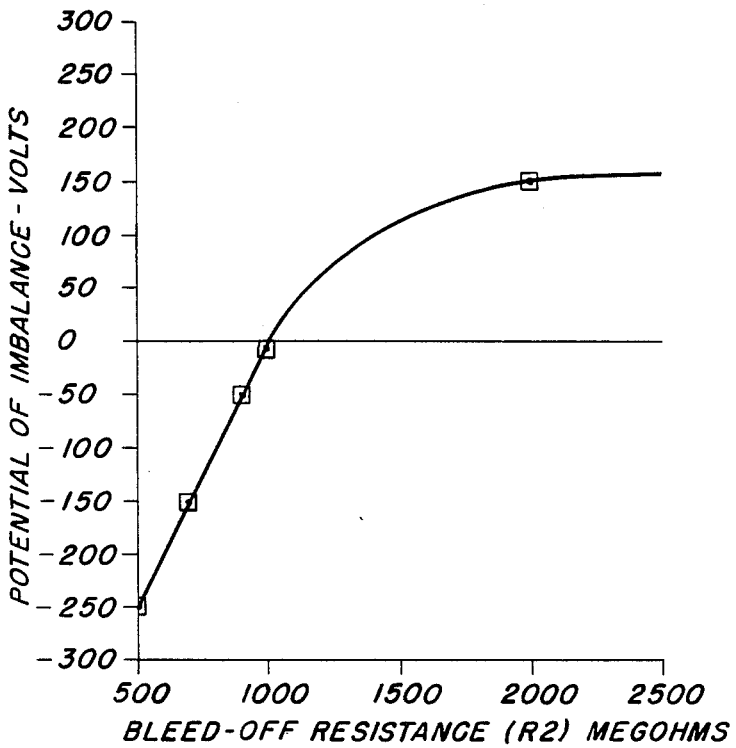
FIG. 10 is a typical curve for an A.C. single-point air ionizing blow-off gun plotting the effect of bleed-off resistance versus the potential of imbalance of an isolated plate.

FIG. 10 is a somewhat similar plot for an A.C. ionizing blow-off gun having one ionizing electrode longitudinally disposed along the axis of the gun's grounded barrel. The total capacitance C2 of the ionizing electrode to ground in this instance was 3 picofarads, while coupling capacitor C1 was 6 picofarads.

The optimum value for the bleed-off resistance R2 is determined by its value where the curve intersects the zero voltage axis. For example, in FIG. 9, the optimum value for the bleed-off resistance R2 would be approximately 41 megohms for the particular A.C. air ionizer employed, whereas in FIG. 10, an appropriate value for the bleed-off resistance R2 on the blow-off gun would be approximately 1,100 megohms.

By choosing an appropriate value of R2 picked off from the plots of FIGS. 9 and 10, for example, or in accordance with the formula, the proper bias on C2 can be maintained so long as corona discharge conditions do not materially change. In practice however, the discharge parameters can vary significantly, especially as a result of changes in environmental conditions or by virtue of corona point contamination, either of which changes corona characteristics.

Figure 11:
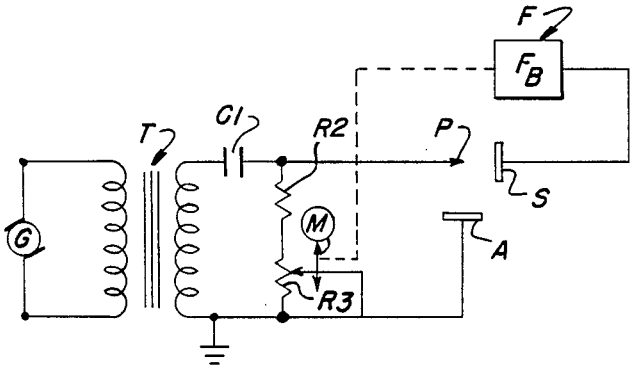
FIG. 11 is a schematic representation of the equivalent circuit for an A.C. capacitively coupled air ionizer showing a sensing and balancing system embodying the present invention.

In order to compensate for these changes, the effective resistance value for R2 can be continuously adjusted by monitoring the degree of variance from a balanced neutral through the use of a sensor S. Referring to FIG. 11, the sensor S continuously monitors the ion current and in response thereto sends the information through a closed loop feedback circuit F to a control mechanism M which actuates variable resistor R3, thus modifying the total bleed-off resistance R2 to compensate for those changes which occur as a result of voltage variations, environmental conditions and contamination or the like. Thus, variable resistor R3 may be a conventional motorized or servo potentiometer whose tap position is appropriately oriented through actuation of closed loop circuit F (via the feedback signal $F_s$) corresponding to the measurement by sensor S of the net charge produced by positive and negative ions.

Although this invention has been described in considerable detail, such description is intended as being illustrative rather than limiting, since the invention may be variously embodied without departing from the spirit thereof, and the scope of the invention is to be determined as claimed.

We claim:

1. In a balancing system for electrical air ionizers having at least one discharge electrode adjacently spaced from a proximity ground and being connected to the high side of an A.C. power source;

(a) a capacitor interposed between each electrode and the high voltage power source in order to maintain a bias on each of the electrodes by blocking the D.C. current across circuit capacitance between the discharge electrodes and ground, and (b) a by-pass resistor across the circuit capacitance for providing a path to ground to bleed off excess bias so that equal positive and negative ion densities are generated during corona flow, said by-pass resistor being selected to have a value determined by the following formula:

$$R2 = \frac{4V_s(C1 + C2)}{V_s(G_-K_-^2 - G_+K_+^2)C1}$$

where $V_s$ is the bias voltage established on capacitor C2 and adjusted by the resistor R2 to compensate for the difference in mobilities of positive and negative ions; $V_s$ is the power supply voltage; C1 is the coupling capacitor capacitance; C2 is the total point-to-ground system capacitance; $G_+$ and $G_-$ are average slopes of current voltage curves for positive and negative corona respectively; and $$K_+ = 1 - \left(\frac{C1 + C2}{C1}\right)\left(\frac{V_o^+}{V_s}\right) \text{and}$$

$$K_- = 1 + \left(\frac{C1 + C2}{C1}\right)\left(\frac{V_o^-}{V_s}\right)$$

where $V_o^+$ and $V_o^-$ are corona onset voltages for positive and negative corona respectively.

2. The air ionizer of claim 1 including a variable resistor in series with the by-pass resistor, a sensor for monitoring the positive and negative ion densities, and circuit means to feedback information monitored to a control mechanism for modifying total by-pass resistance in order to compensate for changes in positive and negative ion flow caused by environmental factors and point contamination.

3. In a balancing system for A.C. air ionizers having at least one discharge electrode adjacently spaced from a proximity ground and being connected to the high side of an A.C. power source;

(a) a capacitor interposed between each point and the high voltage power source to maintain a bias on each of the discharge electrodes by blocking the D.C. current component across circuit capacitance, (b) a variable by-pass resistor across the circuit capacitance for providing a path to ground for bleeding off excess bias so that equal positive and negative ion densities may be generated during corona flow, (c) a sensor for monitoring the positive and negative ion densities, and (d) circuit means to feedback information monitored by the sensor relating to ion densities in a closed loop to control mechanism for modifying the variable by-pass resistor in compensation of the variance from a neutral condition thereof.

4. The air ionizer of claim 3 wherein said discharge electrodes comprise plural points.

5. The air ionizer of claim 3 wherein said at least one discharge electrode comprises a single point axially aligned with a barrel thereof to define a blow-off gun.

6. A method for balancing an air ionizer having at least one discharge electrode adjacently spaced from a proximity ground and being connected to the high side of an A.C. power source comprising the steps of:

(a) interposing a capacitor between each discharge electrode and the high voltage power source for maintaining a bias on each of the electrodes by blocking the D.C. current component, and (b) incorporating a by-pass resistor across circuit capacitance which will provide a path to ground to bleed off excess bias whereby equal positive and negative ion densities will be generated, the value of said by-pass resistor being determined by plotting the relationship between potential of imbalance developed on an isolated metal plate as a result of ion flow from the particular A.C. air ionizer employed versus by-pass resistance and selecting that value of the by-pass resistance which would produce zero voltage imbalance as the equilibrium bias condition.

7. The method of claim 6 including the further step of including a variable resistor in series with said by-pass resistor for adjustable compensation of changes in environmental conditions or point contamination.

* * * * *